US006391837B1

(12) United States Patent
Coleman

(10) Patent No.: US 6,391,837 B1
(45) Date of Patent: May 21, 2002

(54) CLEANING COMPOSITION AND METHOD COMPRISING A TERNARY SOLVENT BLEND

(76) Inventor: Kenneth C. Coleman, 3829 W. Folley St., Chandler, AZ (US) 85226

( * ) Notice: Subject to any disclaimer, the term of this patent is extended or adjusted under 35 U.S.C. 154(b) by 0 days.

(21) Appl. No.: 09/658,288

(22) Filed: Sep. 8, 2000

(51) Int. Cl.[7] ..... C11D 3/44

(52) U.S. Cl. ..... 510/238; 510/271; 510/407; 510/432; 510/362; 510/371

(58) Field of Search ..... 510/238, 271, 510/362, 371, 407, 432

(56) References Cited

U.S. PATENT DOCUMENTS 4,931,204 A * 6/1990 Ramirez et al. ..... 252/167
5,490,948 A * 2/1996 Klier et al. ..... 252/122
5,597,792 A * 1/1997 Klier et al. ..... 510/417
5,811,383 A * 9/1998 Klier et al. ..... 510/417

* cited by examiner

*Primary Examiner*—Charles Boyer
(74) *Attorney, Agent, or Firm*—Dale F. Regelman

(57) ABSTRACT

An improved composition and method for cleaning shower stall floors and bathtub floors. Applicant's composition is formed by combining a first solvent having a dielectric constant of at least about 15.0, a second solvent having a dielectric constant of less than about 3.0, a third solvent comprising one or more carboxylic ester compounds, a first surfactant, and a second surfactant. Applicant's method comprises depolymerizing to form lower molecular weight compounds oligomeric/polymeric residues formed over a period of time from soap oils, bath oils, and body oils. This depolymerization is effected primarily by the polar first solvent. The lower molecular weight compounds formed by the depolymerization of the oligomeric/polymeric residues are then dissolved in the second solvent/third solvent components. That resulting mixture is then emulsified in water using the first surfactant and/or second surfactant. This water emulsion is then rinsed away.

24 Claims, No Drawings

CLEANING COMPOSITION AND METHOD COMPRISING A TERNARY SOLVENT BLEND

FIELD OF THE INVENTION

The present invention relates to an improved cleaning composition and method for use with molded shower stalls and molded bathtub appliances.

BACKGROUND OF THE INVENTION

Regulations were imposed on the hospitality industry at the city, county, state, and/or federal level regarding non-slip features for shower stall and bathtub floors. Shortly thereafter the industry moved away from use of traditional non-slip deterrents such as glued down appliqués and non-skid removable mats Appliqués resulted in hard-to-clean floors due to their high profile, and edges where soil and detritus accumulated and adhered to the adhesive portion of the appliqués. The efficacy of non-skid mats was necessarily dependant upon the guests' use of same. In the event a guest elected not use the mat, legal claims for alleged injuries resulting from slips and falls might nevertheless be pursued.

Thereafter, molded shower stalls and tub units came into widespread use within the hospitality industry. The floor assemblies of such molded units typically contained embossments or ridges, with ridges eventually winning out, to provide what was thought to comprise a permanent non-skid surface. Actual use proved otherwise.

Routine cleaning of these molded units altered the original non-skid surface. Abrasive cleansers and abrasive cleaning pads were the cleaning agents of choice. Daily use of such abrasive cleaners eventually eroded away the non-skid ridges, thereby degrading the non-skid properties of the floor.

In response, the industry moved to non-abrasive acids and/or all purpose cleaners. These cleaners appeared to solve the problem. Again, actual use proved otherwise with a new problem emerging.

Over a period of months-to-years, the non-skid areas of the floor gradually "grayed out "and became unsightly. In addition, the valleys between the ridges slowly filled with some sort of accumulation that, once again, degraded the non-slip properties of the floors. In response, the industry periodically used abrasive cleaners, or volatile organic solvents, to remove such unsightly and dangerous accumulations. After removal of the accumulation, non-abrasive cleaners were routinely then used until an unacceptable accumulation again formed.

The industry hoped that periodic use of abrasive cleaners would not degrade the non-skid properties of the molded floors. Once again, however, actual use proved otherwise. The accumulations in these valleys comprised many layers-upon-layers of material, and required hard scouring with abrasives for up to an hour. Such aggressive cleaning again resulted in erosion of the molded ridges. Volatile solvents such as lacquer thinner did not damage the floor, but toxicity and flammability concerns limited the use of such solvents. Moreover, with the inception of state and federal occupational safety and health programs such as OSHA and NIOSH, strict personal protective equipment and ventilation standards made use of such volatile solvents untenable. As a result, use of lacquer thinner has virtually disappeared from this milieu.

For the past 20–30 years, company after company has submitted cleaning products to the hospitality industry to address this problem. To date, none of the products have proved adequate. As a result, a serious problem still exists today. Guests seeing "grayed out "shower stall and tub floors typically develop a negative perception of both the individual hostelry and of that entire hotel/motel chain. The hospitality industry is intensely aware of these negative perceptions.

As a result, hotel/motel chains and associations regularly inspect their franchisees' facilities. Penalties are assessed for sub-standard conditions. Dirty, unsightly shower stalls and tubs are second only to linens for assessed penalties. Penalties can result in reduced bonuses for managers, loss of franchise rights, demotions, even dismissal. The severity of these penalties has motivated the hospitality industry to find a cost-effective solution to this decades-old problem.

To date, one of the few viable approaches uses yet another abrasive. This particular product uses a jeweler's rouge, which greatly reduces the wear-down of the ridges, but can take hours for complete cleaning of the non-skid surfaces. And, bottom line, though minimized, degradation still occurs.

A new approach is needed which comprises a 2-pronged attack using a single cleaning formulation. First, that formulation must comprise a non-abrasive cleaner that can effectively remove the afore-described accumulation. Second, the formulation must facilitate a preventative maintenance program whereunder once-cleaned units and new units do not experience this problem. Applicant's cleaning composition and method squarely meet both requirements.

SUMMARY OF THE INVENTION

Applicants' novel invention comprises a composition and a method to clean shower stall floors and bathtub floors. Applicant's cleaning composition is formed by combining a first solvent, a second solvent, a third solvent, a first surfactant, and a second surfactant. Applicant's first solvent comprises a polar solvent having a dielectric constant $\epsilon$ of at least 15.0, and preferably at least 30.0. Applicant's second solvent comprises a non-polar solvent having a dielectric constant $\epsilon$ less than 3.0. Applicant's third solvent comprises one or a plurality of ester compounds. Applicant's first surfactant is preferably a nonionic surfactant having an HLB of between about 7 and about 10. Applicant's second surfactant is preferably a nonionic surfactant having an HLB of between about 11 and about 15.

Applicant has found that the undesirable "gray" areas disposed on the floors of shower stalls and bathtubs comprises oligomeric/polymeric residues containing entrapped particulate matter. These oligomeric/polymeric residues are formed over time from soap oils, bath oils, and body oils. Applicant's cleaning method comprises depolymerizing these oligomeric/polymeric residues to form lower molecular weight compounds. This depolymerization is effected by the polar solvent component of Applicant's cleaning composition.

These lower molecular weight are then dissolved in the second solvent and/or third solvent component of Applicant's cleaning composition. This solvent mixture containing the dissolved lower molecular weight compounds is emulsified in water using the first surfactant and/or second surfactant. That emulsified solvent is then rinsed away using water.

In addition, Applicant has found that depolymerization of the oligomeric/polymeric resides releases the entrapped particulate matter. That released particulate matter is then also emulsified in water using the first surfactant and/or second surfactant, and rinsed away.

DETAILED DESCRIPTION OF THE PREFERRED EMBODIMENTS

Applicant has found that the above-described accumulation of unsightly material in the non-skid valleys of molded shower/tub floors is not merely simple soil and/or dirt. Quite to the contrary, Applicant has discovered that this agglomerate actually comprises a layered build-up of soap oils, bath oils, and body oils. These various organic compounds oligomerize/polymerize over time upon exposure to ambient air. By oligomerization, Applicant means the formation of higher molecular weight compounds from lower molecular weight compounds, wherein the higher molecular weight compounds comprise liquids, viscous liquids, and semi-solid materials. By polymerization, Applicant means the formation of high molecular weight compounds from lower molecular weight compounds, wherein the higher molecular weight materials comprise solid materials.

The resulting layers of oligomers and/or polymers entrap particulates, including dirt, soils, incompletely polymerized oils, and the like. Applicant has discovered that such oligomers/polymers, including the entrapped particulates, comprise the "accumulation" discussed above.

Applicant has further discovered that these oligomeric/polymeric materials, with their entrapped particulates, chemically and/or mechanically bond to the polymeric coating used on the floor portions of shower stall and tub units. Applicant has developed a cleaning composition and method to remove these undesirable oligomeric/polymeric materials without degrading the molded shower/tub floor or the polymeric coating disposed on same.

Applicant's cleaning formulation is formed from mixing a first solvent, a second solvent, a third solvent, a first surfactant, and a second surfactant. These components can be mixed in any order using conventional equipment and techniques.

Applicant's first solvent comprises a polar solvent having a dielectric constant $\epsilon$ of at least 15.0. Preferably, this first solvent has a dielectric constant of 30.0 or greater. As those skilled in the art will appreciate, the dielectric constant of a substance, often called the permittivity, is the ratio of the electric displacement D to the electric field strength E when an external field is applied to the substance. The dielectric constant values recited below comprise the relative permittivities, which comprise the ratios of actual permittivities to the permittivity of a vacuum, and hence, are dimensionless numbers.

Applicant has discovered that when his cleaning formulation contains at least one solvent having a dielectric constant of at least 15.0, that cleaning formulation cleaves the above-described oligomeric/polymeric residues into lower molecular weight components. Such lower molecular weight materials can then be dissolved in solvents of low to medium polarity, such as Applicant's second and third solvents.

Suitable compounds for use as Applicant's first solvent include butyrolactone ($\epsilon$=39.0), N-methylpyrrolidone ("NMP") ($\epsilon$=32.55), N,N-dimethylformamide ("DMF") ($\epsilon$=38.25), acetone ($\epsilon$=20.7), methyl ethyl ketone ($\epsilon$=18.5), cyclohexanol ($\epsilon$=16.4), and mixtures thereof. $\gamma$-Butrolactone, NMP, and DMF are preferred.

Applicant's first solvent is added to Applicant's formulation in an amount between about 25 and about 40 weight percent. Preferably, the first solvent is added in an amount between about 30 and about 35 weight percent.

Applicant's second and third solvents dissolve, among other things, the lower molecular weight compounds resulting from depolymerization of oligomeric/polymeric residues. Applicant's second solvent is a non-polar organic compound having a dielectric constant $\epsilon$ less than 3.0. In order to control the flash point of the formulation, Applicant's first solvent preferably comprises hydrocarbon compounds having at least six (6) carbon atoms. Organic solvents such as hexane ($\epsilon$=1.89), heptane ($\epsilon$=1.92), octane ($\epsilon$=1.95), nonane ($\epsilon$=1.97), decane ($\epsilon$=1.99), and the like may be used. Naturally-occurring compounds are preferred. Terpene-derived compounds such as limonene ($\epsilon$=2.37), the pinenes ($\epsilon$=2.18–2.50), the terpinenes ($\epsilon$=2.27–2.45), terpinolene ($\epsilon$=2.29), and mixtures thereof, are preferred. Cold pressed natural oils, such as orange oil, obtained from pressing fruits, i.e. oranges, contain mixtures of terpene-derived, unsaturated hydrocarbon compounds having pleasant odors, and hence, are most preferred.

Applicant's second solvent is added to Applicant's formulation in an amount between about 5 weight percent and about 25 weight percent. Preferably, the second solvent is added to Applicant's formulation in an amount between about 6 weight percent and about 20 weight percent.

Applicant's third solvent comprises one or more saturated and/or unsaturated ester compounds. Many of these esters are derived from soy bean oil. As those skilled in the art will appreciate, such esters are formed by reacting one mole of a carboxylic acid and one mole of an alcohol with the removal of one mole of water.

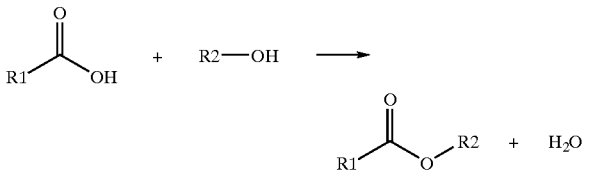

Tables I and II set forth preferred carboxylic acids, i.e. the R1 component, and preferred alcohols, i.e. the R2 component, respectively, used to form the preferred ester compounds comprising Applicant's third solvent.

TABLE I

| Preferred R1 - COOH |
|---|
| Hexadecanoic Acid (Palmitic Acid) |
| Octadecanoic Acid (Stearic Acid) |
| 9 - Octadecenoic Acid (Oleic Acid) |
| 9, 12 - Octadecadienoic Acid (Linoleic Acid) |
| 9, 12, 15 - Octadecatrienoic Acid (Linolenoic Acid) |

TABLE II

| PREFERRED R2 - OH |
|---|
| Methanol |
| Ethanol |
| n-Propanol |
| 2-Propanol |
| n-Butanol |
| 2-Butanol |
| t-Butanol |

Applicant's third solvent is preferably formed from one or more of the ester compounds formed using the ingredients recited in Tables I and II. Methyl palmitate, methyl stearate, methyl oleate, methyl linoleate, methyl linolenate, and mixtures thereof are most preferred. Applicant's third solvent is added in an amount between about 15 weight percent and about 35 weight percent.

Applicant's formulation is further formed by adding a first surfactant which, among other things, emulsifies and solubilizes the individual components of Applicant's cleaning composition. Anionic, cationic, amphoteric, or nonionic surfactants may be used. Nonionic surfactants are preferred. Nonionic surfactants having a Hydrophilic Lipophilic Balance ("HLB") between about 7 and about 10 are most preferred. Such nonionic surfactants may comprise linear polyoxyethylene ("POE")/alkyl ethers, POE sorbitan esters, and mixtures thereof.

Alkyl polyoxyethylene ethers may be described as a POE X Alkyl Ether, wherein the X represents the average number of repeat units of ethylene oxide reacted with an alkyl alcohol to form the ether. For example, POE 10 stearyl ether is formed by reacting, on the average, 10 ethylene oxide molecules with one stearyl alcohol molecule. Those skilled in the art will appreciate that the polymerization reaction of ethylene oxide cannot be precisely controlled. Therefore, the actual distribution of oxyethylene units for any given average may be quite wide.

Table III sets forth commercially available surfactants suitable for use as Applicant's first surfactant. Applicant's first surfactant is added to the cleaning composition in an amount between about 10 weight percent and about 20 weight percent.

TABLE III

| Name | Type | Chemical Family | HLB | Company |
|---|---|---|---|---|
| Alfonic 1412-3 | Nonionic | Ethoxylated Linear Alcohol (40% E/O) | 8.0 | Condea Vista |
| Alfonic 810-2 | Nonionic | Ethoxylated Linear Alcohol (40% E/O) | 8.0 | Condea Vista |
| BioSoft E-400 | Nonionic | Primary Alcohol Ethoxylate | 8.0 | Stepan |
| BioSoft TD-400 | Nonionic | Primary Alcohol Ethoxylate | 8.0 | Stepan |
| Delonic LF-EP-30 | Nonionic | Alkoxylated Linear Alcohol | 8.0 | DeForest |
| Genapol 26-L-3 | Nonionic | Natural Linear Alcohol Ethoxylate | 8.0 | Clariant |
| Genapol 26-L-3 | Nonionic | ($C_{12-16}$) Natural Linear Alcohol Ethoxylate | 8.0 | Clariant |
| Iconol TDA-3 | Nonionic | TriDccyl Alcohol | 8.0 | BASF |
| Rhodasurf LA-3 | Nonionic | ($C_{12-15}$) Straight Chain Fatty Alcohol Ethoxylate | 8.0 | Rhodia |
| Surfonic L24-3 | Nonionic | Linear Alcohol Ethoxylate | 8.0 | Huntsman |
| Surfonic TDA-3B | Nonionic | Linear Alcohol Ethoxylate | 8.0 | Huntsman |
| T-Det A-243 | Nonionic | Linear Alcohol Ethoxylate | 8.0 | Harcross |
| Ethal EH-2 | Nonionic | Ethoxylated Alcohol | 8.1 | Ethox |
| Surfonic LA-3 | Nonionic | Linear Alcohol Ethoxylate | 8.2 | Huntsman |
| Surfonic L12-2.6 | Nonionic | Linear Alcohol Ethoxylate | 8.2 | Huntsman |
| Tergitol 15-S-3 | Nonionic | $C_{12-14}$ Secondary Alcohol Ethoxylate | 8.3 | Union Carbide |
| Neodol 91-2.5 | Nonionic | $C_{9-11}$ Linear Primary Alcohol Ethoxylate | 8.5 | Shell |
| Tomadol 91-2.5 | Nonionic | Linear Primary Alcohol Ethoxylate | 8.5 | Tomah |
| Neodol 1-3 | Nonionic | $C_{9-11}$ Linear Primary Alcohol Ethoxylate | 8.7 | Shell Canada |
| Tomadol 1-3 | Nonionic | $C_{9-11}$ Linear Primary Alcohol Ethoxylate | 8.7 | Tomah |
| Trycol 5966 | Nonionic | Ethoxylated Alcohol | 8.7 | Henkel |
| Precept Series 8140 | Amphoteric | Lecithin & Derivitives | 8.0–9.0 | Central Soya |
| Precept Series 8160 | Amphoteric | Lecithin & Derivitives | 8.0–9.0 | Central Soya |
| Promidium SX PPG-3 | Nonionic | Hydroxyethyl Soyamide | 8.0–9.0 | Uniquema (ICI) |
| Blendmax Series | Amphoteric | Enzyme Modified Lecithin | 8.0 | Central Soya |
| Clearate WDF | Nonionic | Soya Lecithin | 8.0 | W. A. Cleary |
| Mazclean EP | Nonionic | Orange Oil Emulsifier | n/a | PPG Mazer |
| Videt ME-80 | Anionic | Orange Oil Emulsifier | n/a | Vitech Int'l |
| EZ-Mulze | Anionic | Orange Oil Emulsifier | n/a | Florida Chem |
| Videt QX-9 | Anionic | Specialty Surfactant Blend | n/a | Vitech Int'l |

Applicants' formulation is further formed by adding a second surfactant. Applicant has found that this second surfactant, among other things, emulsifies the first solvent and the second solvent, and aids in emulsifying the solubilized lower molecular weight compounds resulting from depolymerization of the above-described oligomeric/polymeric residues.

Anionic surfactants, cationic surfactants, amphoteric surfactants, nonionic surfactants, and mixtures thereof may be used. Nonionic surfactants having an HLB between about 10 and about 15 are preferred. Such nonionic surfactants may comprise linear polyoxyethylene ("POE")/alkyl ethers, POE sorbitan esters, and mixtures thereof.

Sorbitan is formed by the cyclodehydration of sorbitol. Thus, sorbitan has multiple hydroxyl groups that can serve as reaction points for forming ethers or esters. Sorbitan ester surfactants are available as monoesters, diesters, triesters, and sesquiesters. In addition, the actual distributions of ether side chains formed by reaction of sorbitan with ethylene oxide may be quite wide.

Table IV sets forth commercially available products which may be used as Applicant's second surfactant. Applicant's second surfactant is added to the cleaning composition in an amount between about 10 weight percent and about 20 weight percent.

TABLE IV

| Name | Type | Chemical Family | HLB | Company |
|---|---|---|---|---|
| Tween 21 | Nonionic | POE 4 sorbitan monolaurate | 13.3 | ICI Americas, Inc. |
| Tween 80 | Nonionic | POE 20 sorbitan mono-oleate | 15.0 | ICI Americas, Inc. |
| Tween 81 | Nonionic | POE 5 sorbitan mono-oleate | 10.0 | ICI Americas, Inc. |

TABLE IV-continued

| Name | Type | Chemical Family | HLB | Company |
|---|---|---|---|---|
| Tween 85 | Nonionic | POE sorbitan trioleate | 11.0 | ICI Americas, Inc. |
| Brij 76 | Nonionic | POE stearyl ether | 12.4 | ICI Americas, Inc. |
| Brij 78 | Nonionic | POE 20 stearyl ether | 15.3 | ICI Americas, Inc. |
| Alkamuls EL-719 | Nonionic | POE 40 triricinoleoyl glycerol | 13.6 | Schibley Chemicals |
| Neodol 91-6 | Nonionic | $C_{9-11}$ Linear Primary Alcohol Ethoxylate | 12.5 | Shell Canada |
| Igepal CO-530 | Nonionic | POE 6 nonylphenyl ether | 10.8 | Rhone-Poulene, Inc. |
| Igepal CO-610 | Nonionic | POE 7.5 nonylphenyl ether | 12.2 | Rhone-Poulene, Inc. |
| Igepal CO-630 | Nonionic | POE 9 nonylphenyl ether | 13.0 | Rhone-Poulene, Inc. |
| Igepal CO-720 | Nonionic | POE 12 nonylphenyl ether | 14.2 | Rhone-Poulene, Inc. |

The following examples are presented to further illustrate to persons skilled in the art how to make and use the invention and to identify presently preferred embodiments thereof. These examples are not intended as limitations, however, upon the scope of the invention, which is defined only by the appended claims.

EXAMPLE 1

Example No. 1 comprises an aggressive cleaning formulation. The formulation for this embodiment is recited in Table V. This embodiment has a flash point of 135° F. For safety reasons, Applicant's invention is limited to formulations having flash points of 135° F. or higher.

TABLE V

| | |
|---|---|
| Butyrolactone | 30.20 |
| SoyGold 1500 | 17.62 |
| Orange Oil | 17.28 |
| Neodol 91-2.5 | 17.45 |
| Neodol 91-6.0 | 17.45 |

SoyGold 1500 is sold commercially by AG Environmental Products, LLC, 9804 Pflumm Road, Lenexa, KS 66215. SoyGold 1500 comprises methyl palmitate at 10.0 weight percent, methyl stearate at 4.0 weight percent, methyl oleate at 25.0 weight percent, methyl linoleate at 53.0 weight percent, and methyl linolenate at 8.0 weight percent. Neodol 91-2.5 and Neodol 91-6.0 are sold commercially by Shell Chemicals Canada Limited, Post Office Box 4280 Station C, 400-4$^{th}$ Avenue South West, Calgary, Canada.

EXAMPLE 2

Example 2 comprises a less aggressive cleaning formulation. However, this embodiment has an increased flashpoint of 181° F. The formulation for this embodiment is recited in Table VI.

TABLE VI

| | |
|---|---|
| Butyrolactone | 34.00 |
| SoyGold 1500 | 30.00 |
| Orange Oil | 6.00 |
| Neodol 91-2.5 | 15.00 |
| Neodol 91-6.0 | 15.00 |

Applicant's invention also comprises a method to clean molded shower stall floors and bathtub floors. According to Applicant's method, the above-described oligomeric/polymeric residues are first cleaved into lower molecular weight compounds. These lower molecular weight compounds are then dissolved in the solvent portion of Applicant's cleaning composition. This solution is then emulsified in water using Applicant's first surfactant and/or second surfactant. The resulting water emulsion is then simply rinsed away.

Applicant has found that depolymerization of the oligomeric/polymeric residues releases the formerly entrapped particulate matter. These released particulates are emulsified using Applicant's first surfactant and/or second surfactant. These emulsified particulates are then also rinsed away using water.

To accomplish these various steps, Applicant's cleaning formulation is poured, wiped, or sprayed onto the grayed non-skid area of the shower stall or tube floor. The oligomeric/polymeric residues are then impregnated with Applicant's cleaning formulation by mechanically scrubbing those residues with either a fine bristle brush or a "white "(non-scratch) Scotch-Brite® pad. The formulation-impregnated residues are then allowed to stand 8–10 minutes. At this point in the process, Applicant's cleaning formulation is depolymerizing the oligomeric/polymeric residues.

The treated residues are then mechanically scrubbed in the presence of water. This mechanical action promotes dissolution and emulsification of the now-depolymerized residues and released particulates. The solubilized/emulsified oils and particulates are then rinsed away using water.

Non-skid areas may require 1–2 repetitions of this process, depending upon the thickness of the agglomeration and the tenacity of adhesion of the agglomeration to the floor surface. These repetitive steps can be performed either same visit or within 2–3 days.

For maintaining once-cleaned appliance floors, or the floors of new units, about one ounce of product used weekly will prevent the agglomerates from building. Under such a maintenance program, the 8–10 minute dwell-time is not required.

The efficacy of Applicant's formulation to prevent formation of the oligomeric/polymeric resides described above has been verified by actual testing. Two (2) cross-sections of a non-skid surface were examined using a microscope at a magnification of 500 times. One (1) gram of a bath and soap oil mixture was wiped across each test specimen, and allowed to stand for twelve (12) hours in an oxygen-enriched environment.

Both test specimens were then cleaned with an off-the-shelf general purpose cleaner. The entire test process was repeated for seven (7) days. One of the test specimens (the "Treated Specimen") was then cleaned using Applicant's formulation set forth in Table VI and using Applicant's method recited above. The other test specimen (the "Untreated Specimen") remained as is. Both test specimens were then again examined under the microscope.

The Treated Specimen showed no discernable build-up. In marked contrast, however, the Untreated Specimen had a visible build-up of residue. When that residue was scraped with a dental pick it showed a tenacious adhesion to the surface of the Untreated Specimen.

I claim:

1. A cleaning composition, comprising:

a first solvent having a dielectric constant of at least 15.0, wherein said first solvent is selected from the group consisting of butyrolactone, N-methylpyrrolidone, N,N-dimethylformamide, acetone, methyl ethyl ketone, cyclohexanol, and mixtures thereof;

a second solvent having a dielectric constant less than 3.0;

a third solvent, wherein said third solvent comprises one or a plurality of esters, wherein each of said one or plurality of esters is formed from a carboxylic acid having at least ten carbon atoms and an alcohol having between one and four carbon atoms;

a first surfactant, a second surfactant;

wherein said first solvent is present in an amount of between about 25 weight percent and about 40 weight percent, and wherein said second solvent is present in an amount between about 5 weight percent and about 25 weight percent, and wherein said third solvent is present in an amount between about 15 weight percent and about 35 weight percent.

2. The composition of claim 1, wherein said first surfactant is present in an amount between about 10 weight percent and about 20 weight percent, and wherein said second surfactant is present in an amount between about 10 weight percent and about 20 weight percent.

3. The composition of claim 2, wherein said first surfactant is selected from the group consisting of a cationic surfactant, an anionic surfactant, an amphoteric surfactant, a nonionic surfactant, and mixtures thereof.

4. The composition of claim 3, wherein said second surfactant is selected from the group consisting of a cationic surfactant, an anionic surfactant, an amphoteric surfactant, a nonionic surfactant, and mixtures thereof.

5. The composition of claim 4, wherein said first surfactant comprises a nonionic surfactant having an HLB of between about 7 and about 10.

6. The composition of claim 5, wherein said second surfactant comprises a nonionic surfactant having an HLB of between about 11 and about 15.

7. The composition of claim 6, wherein said third solvent comprises methyl palmitate, methyl stearate, methyl oleate, methyl linoleate, and methyl linolenate.

8. The composition of claim 1, wherein said second solvent comprises orange oil.

9. The composition of claim 1, wherein said first solvent has a dielectric constant of at least 30.0.

10. A cleaning composition formed by combining:

a first solvent having a dielectric constant of at least 15.0, wherein said first solvent is selected from the group consisting of butyrolactone, N-methylpyrrolidone, N,N-dimethylformamide, acetone, methyl ethyl ketone, cyclohexanol, and mixtures thereof, a second solvent having a dielectric constant less than 3.0;

one or a plurality of esters, wherein each of said one or plurality of esters is formed from a carboxylic acid having at least ten carbon atoms and an alcohol having between one and four carbon atoms;

a first surfactant;

a second surfactant;

wherein said first solvent is added in an amount of between about 25 weight percent and about 40 weight percent, and wherein said second solvent is added in an amount between about 5 weight percent and about 25 weight percent, and wherein said one or a plurality of esters is added in an amount between about 15 weight percent and about 35 weight percent.

11. The composition of claim 10, wherein said first surfactant is added in an amount between about 10 weight percent and about 20 weight percent, and wherein said second surfactant is added in an amount between about 10 weight percent and about 20 weight percent.

12. The composition formed by the process of claim 11, wherein said first surfactant is selected from the group consisting of a cationic surfactant, an anionic surfactant, an amphoteric surfactant, a nonionic surfactant, and mixtures thereof.

13. The composition formed by the process of claim 12, wherein said second surfactant is selected from the group consisting of a cationic surfactant, an anionic surfactant, an amphoteric surfactant, a nonionic surfactant, and mixtures thereof.

14. The composition formed by the process of claim 13, wherein said first surfactant comprises a nonionic surfactant having an HLB of between about 7 and about 10.

15. The composition formed by the process of claim 14, wherein said second surfactant comprises a nonionic surfactant having an HLB of between about 10 and about 15.

16. The composition formed by the process of claim 15, wherein said one or plurality of esters comprises methyl palmitate, methyl stearate, methyl oleate, methyl linoleate, and methyl linolenate.

17. The composition formed by the process of claim 16, wherein said second solvent comprises orange oil.

18. The composition formed by the process of claim 10, wherein said first solvent has a dielectric constant of at least 30.0.

19. A method to clean shower stall floors and bathtub floors using the composition of claim 1, comprising the steps of:

depolymerizing oligomeric/polymeric residues disposed on said shower stall floors and bathtub floors to form lower molecular weight compounds;

emulsifying in water said lower molecular weight compounds; and rinsing away with water said emulsified lower molecular weight compounds.

20. The method of claim 19, wherein said depolymerizing step further comprises applying to said oligomeric/polymeric residues a cleaning formulation comprising a polar solvent having a dielectric constant of at least 15.0.

21. The method of claim 20, wherein said polar solvent has a dielectric constant of at least 30.0.

22. The method of claim 20, wherein said depolymerization step further comprises:

impregnating said oligomeric/polymeric residues with said cleaning formulation by mechanically scrubbing said oligomeric/polymeric residues after applying said cleaning formulation;

allowing said impregnated oligomeric/polymeric residues to stand for between about 8 to about 10 minutes; and scrubbing said impregnated oligomeric/polymeric residues.

23. The method of claim 22, wherein said oligomeric/polymeric residues contain entrapped particulate matter, further comprising the steps of:

releasing said entrapped particulate matter;

emulsifying said particulate matter in water; and rinsing away with water said emulsified particulate matter.

24. The method of claim 23, further comprising the steps of:

dissolving said lower molecular weight compounds in a cleaning composition comprising a non-polar solvent having a dielectric constant less than 3.0;

forming a water emulsion containing said dissolved lower molecular weight compounds; and rinsing away said water emulsion.

* * * * *